US006176185B1

(12) United States Patent
Charlier et al.

(10) Patent No.: US 6,176,185 B1
(45) Date of Patent: Jan. 23, 2001

(54) METHOD FOR MARKING A GAMING DISK BY PAD PRINTING

(75) Inventors: Gérard Charlier, Paris; Eric Philippe, Grans; Michel Tollhupp, Beaune, all of (FR)

(73) Assignee: Etablissements Bourgogne et Grasset, Savigny-les-Beaune (FR)

( * ) Notice: Under 35 U.S.C. 154(b), the term of this patent shall be extended for 0 days.

(21) Appl. No.: 09/147,253

(22) PCT Filed: Mar. 11, 1998

(86) PCT No.: PCT/FR98/00485

§ 371 Date: Nov. 12, 1998

§ 102(e) Date: Nov. 12, 1998

(87) PCT Pub. No.: WO98/43816

PCT Pub. Date: Oct. 8, 1998

(30) Foreign Application Priority Data

Mar. 28, 1997 (FR) ..... 97 03872

(51) Int. Cl.[7] ..... B41F 17/16

(52) U.S. Cl. ..... 101/493; 101/492; 101/35; 101/41; 101/170

(58) Field of Search ..... 101/35, 41, 42, 101/43, 44, 150, 163, 167, 169, 170, 483, 493, 492

(56) References Cited

U.S. PATENT DOCUMENTS 2,748,696 * 6/1956 Murray ..... 101/41
3,868,902 * 3/1975 Bradshaw et al. ..... 101/44
4,019,436 4/1977 Handweiler et al. ..... 101/41
5,794,532 8/1998 Gassies et al. ..... 101/493

FOREIGN PATENT DOCUMENTS

2463683 * 4/1981 (FR) ..... 101/41
2730392 8/1996 (FR) .
87/00796 2/1987 (WO) .

OTHER PUBLICATIONS

Patent Abstracts of Japan, vol. 13, No. 83 (M–802), published Feb. 27, 1989.

Patent Abstracts of Japan, vol. 9, No. 152 (M–391), published Jun. 27, 1985.

* cited by examiner

*Primary Examiner*—Kimberly Asher
*Assistant Examiner*—Leslie J. Grohusky
(74) *Attorney, Agent, or Firm*—Greenblum & Bernstein, P.L.C.

(57) ABSTRACT

A method for marking a side of a straight-sided chip with a decoration by pad printing. The method comprises providing an ink plate with an image defined by radially deformed representation of the decoration of the straight side of the chip in a ring-shaped zone, moving a pad coaxially into contact with the ink plate such that the image transfers to the pad, and moving the pad coaxially into contact with the chip such that the image transfers to the side of the chip.

14 Claims, 3 Drawing Sheets

METHOD FOR MARKING A GAMING DISK BY PAD PRINTING

CROSS-REFERENCE TO RELATED APPLICATIONS

This is a national stage application, under 35 USC §37, of international application No. PCT/FR98/00485, filed Mar. 11, 1998.

TECHNICAL FIELD

The present invention relates to the marking of gambling chips having the general shape of a disc, or of objects of similar shape, by pad printing. Gambling chip, also called casino chip, should be understood to mean any element which can be used in gambling halls and represents a nominal value which may or may not be predetermined. Generally, these chips are manufactured from a rigid and scratch-resistant plastic.

Gambling chips are, almost systematically, given a decoration by marking on their faces and/or sides, this decoration, depending on the eventual uses of the chips, possibly ranging from the simplest to the most complex. For the rest of the specification, the term decoration should be understood in its widest sense and it comprises, in particular, any drawing, symbol, mark and character (for example, letters, numbers, bar codes or various codings) capable of graphical representation and/or having a visual or optical effect (for example, by the use of U.V.-sensitive ink). More specifically, the decoration of the chips is capable of fulfilling at least one of the several functions presented briefly below:

i) a chip and/or chip value and/or casino and/or gambling table and/or gambler identification function;

ii) a decoration function, the decoration having an aesthetic aspect and/or acting as an advertising medium; and iii) a chip-authentication and security function, for combatting the risk of falsification and/or the risk of fraudulent reproduction.

PRIOR ART

Patent FR 2,730,392 in the name of the Applicant describes the use of pad printing for marking the surface of the faces and/or side of chips (as opposed to volume marking using multi-shot injection moulding of variously coloured plastics). In particular, this patent describes the marking of each face of the chip by pad printing using an inked pad which is moved coaxially with the chip with, for chips having a soft-profiled side without a straight side, marking of part of the side corresponding to the chamfered or rounded edge of the face of the chip. However, this technique, although satisfactory for the faces of the chip, is not always accepted by casinos for the side as it results in substantial modification of the profile of the side and/or in incomplete marking of the latter.

Moreover, again according to Patent FR 2,730,392, side marking for straight-sided chips is carried out by lateral marking using a rotating pad (or a rotating pad/roller for marking several stacked chips simultaneously). However, this technique, whose means of implementation are quite complex and expensive, is not always satisfactory, especially when the side decoration has to be reproduced with very great positional accuracy over the entire circular perimeter of the straight side (writing, bar code and various codings, periodic circular drawing). In particular, since the principle of the rotating roller implies a point of origin on the side of the chip for the marking operation proper, this results in the formation of a "join" (either a blank or an overlap) in the decoration after marking the side over one complete revolution of the chip, the "join" being all the more difficult to avoid as the manufacturing tolerances of the chip cause slight, but quite real, variations in the diameter of the chips.

DESCRIPTION OF THE INVENTION

It stems from the foregoing that there is a need for a new method of marking straight-sided gambling chips which eliminates, or appreciably reduces, the limitations and other drawbacks presented above.

For this purpose, the invention provides a method of marking the side of a straight-sided disc-shaped gambling chip or an object of similar shape by pad printing, characterized by the use of an inked pad which is moved coaxially with the said chip in conjunction with a flat ink plate having a ring-shaped zone suitable for being placed coaxially with the pad and bearing a decoration image defined by a radially deformed representation of the decoration of the straight side of the chip.

Thus, the use of the decoration image which is radially deformed with respect to the side decoration makes it possible to distribute the effect of distortion on the final decoration due to the variations in diameter of the chip over the entire circumferential perimeter of the side of the chip and to make this effect negligible.

According to a first variant of the invention, the decoration image is obtained by the combination of an operation of radially folding up the decoration for the side of the chip around a facial edge included in the plane of the ink plate and of an operation of contracting the decoration towards the said facial edge, the sequential or chronological order in which the two operations are performed being of no consequence.

In particular, according to a first way of implementing the method of the invention, the decoration image is obtained from an intermediate decoration produced by radially folding up the side decoration into a reference plane corresponding to the plane of the ink plate and including one of the faces of the chip (the reference face), by means of a radial transformation of contraction of the intermediate decoration in the reference plane towards the centre of the ring bearing the decoration image.

Advantageously, the position of the internal circular border of the ring and the contraction coefficient of the radial transformation are determined, for a given straight-sided chip model and a given pad, by marking the chip model using a positioning ink plate set on the axis of the chip and bearing a pattern consisting of closely-spaced concentric circles.

Most advantageously, the characteristics of the radial contraction transformation are chosen in order to obtain a reduction in the radial height of the intermediate decoration (equal in height to the side decoration) of between 25 and 40%, i.e. a radial contraction coefficient of between 0.75 and 0.6.

In practice, the magnitude of the radial contraction and of the associated reduction in height of the side decoration depend on the deformation of the pad on the surface of the chip, in other words they depend on the type of chip to be marked, on the profile and nature of the pad (material, hardness, surface finish) and, to a lesser extent, on the inks employed.

Moreover, in order to solve the problem of the colours of the decoration marked on the side of the chip lightening due to the inked pad stretching, use is made, according to two variants of the invention, either of an ink plate having a halftone decoration image for a face of the chip and a non-halftone side decoration image or an ink plate having a decoration image for a face of the chip and a deeply-etched side decoration image, the etching of the side decoration image then being deeper than the etching of the decoration image for the face of the chip.

Moreover, by making the internal circular border of the ring come into correspondence with the edge of the reference face of the chip, the heightwise positioning of the decoration is facilitated for marking a solid-straight-sided chip. Likewise, it is advantageous, in the radial contraction transformation, to use as relative origin on each radius OR the corresponding point A on the edge of the reference face of the chip.

It should be pointed out that the invention also applies to soft-edged chips having a central straight side extending substantially over a large portion of the thickness of the chip and connected to the two faces of the latter by two transition zones (small fillets or broadened chamfers).

According to another variant of the invention, these central-straight-sided chips are marked by making the internal circular border of the ring to correspond approximately to the circle of axial projection of the straight side on the reference face of the chip.

According to yet another variant of the method according to the invention, an axially symmetric deformable pad is used which has a diameter at least equal to the diameter of the chip increased by about five times the height of the side of the chip.

Apart from the chips and other straight-sided objects of similar shape, the straight side of which is pad-printed using the method of the invention defined above, the invention also relates to a pad-printing device suitable for implementing this method, which includes a support for the chip, the said support being equipped with means for centering the chip coaxially with the pad before the operation of marking the side by pad printing, the centering means being retractable in order to allow the side of the chip to be marked during movement of the pad.

Advantageously, the retractable centering means, of the type consisting of slides or of a centering ring, are mounted so as to slide axially over the perimeter of the support.

Most advantageously, the device according to the invention includes means for holding the chip in place on its support, especially when raising the pad. In particular, the means for holding the chip in place consist of at least one adhesive patch, in contact with that face of the chip which bears on the support, and/or of suction under vacuum.

Other characteristics and advantages of the present invention will appear on reading the description which follows, with reference to the drawings appended hereto.

BRIEF PRESENTATION OF THE DRAWINGS

Figure 3:
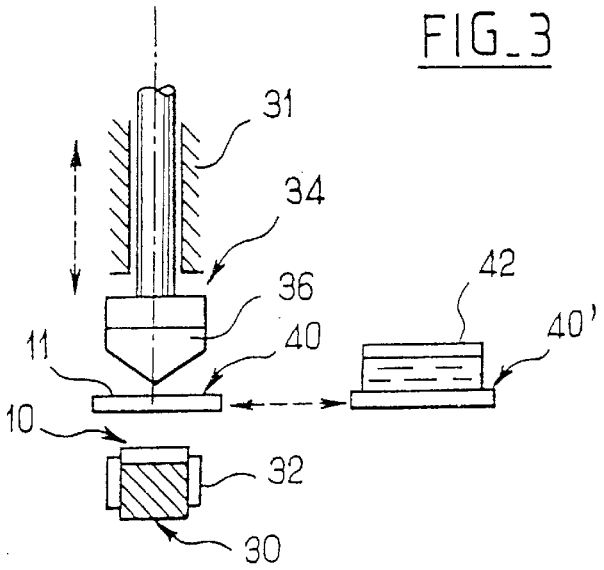
FIG. 3 is a diagram showing the principle of operation of a pad-printing apparatus allowing implementation of the method of the invention.
Figure 4A:
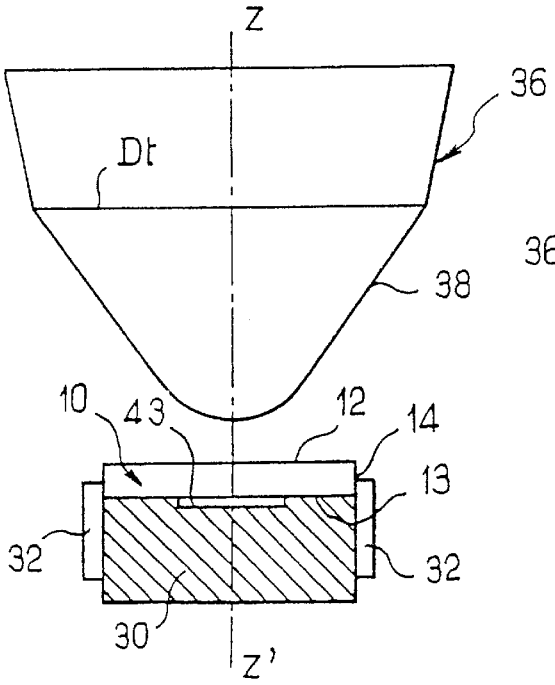
Figure 4B:
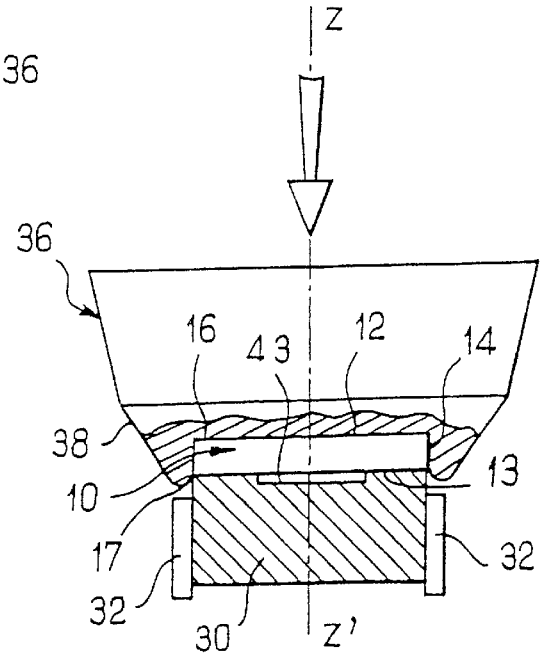
Figure 5:
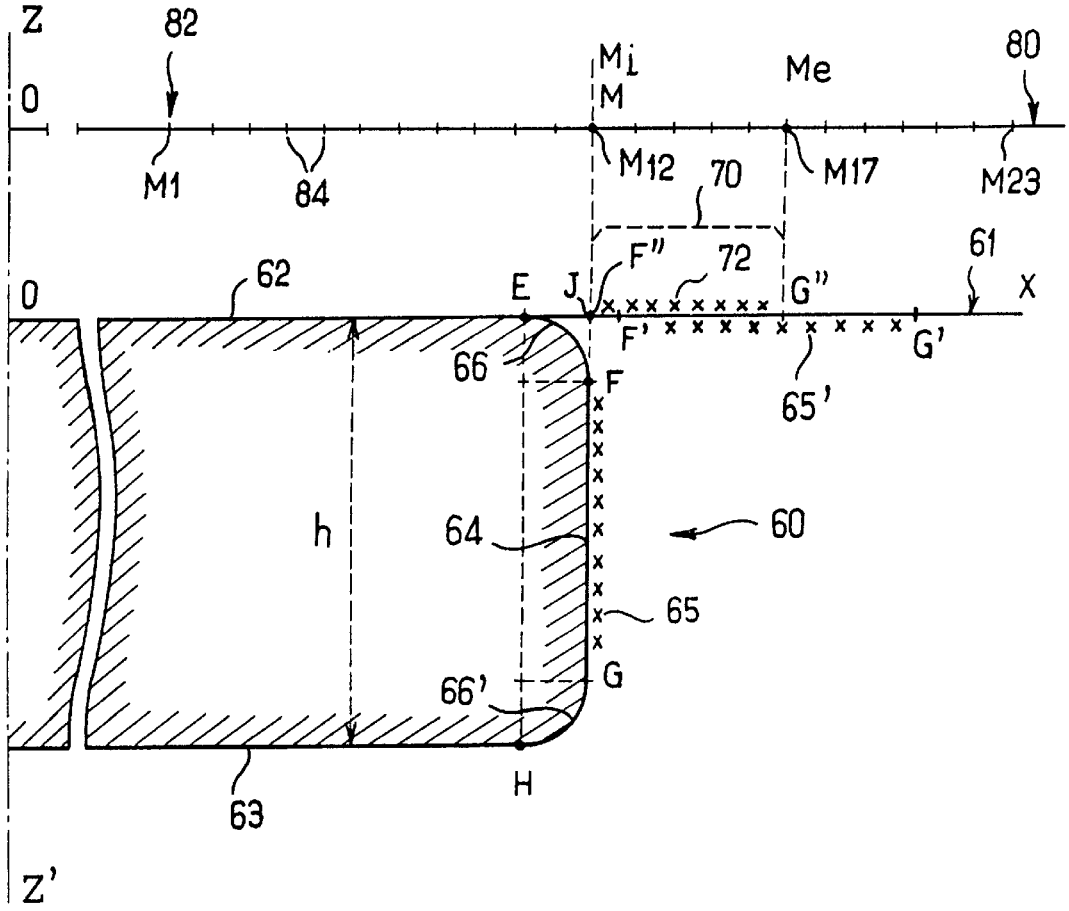

FIGS. 4*a* and 4*b* show an operation of marking the side of a straight-sided gambling chip by pad printing using the device illustrated in FIG. 3; and FIG. 5 shows an enlarged sectional diagrammatic view of a central-straight-sided gambling chip and of the corresponding ink plate used for decorating the straight side of the chip using the method of the invention.

PREFERRED WAYS OF IMPLEMENTING THE INVENTION AND PREFERRED EMBODIMENTS THEREOF

Figure 1:
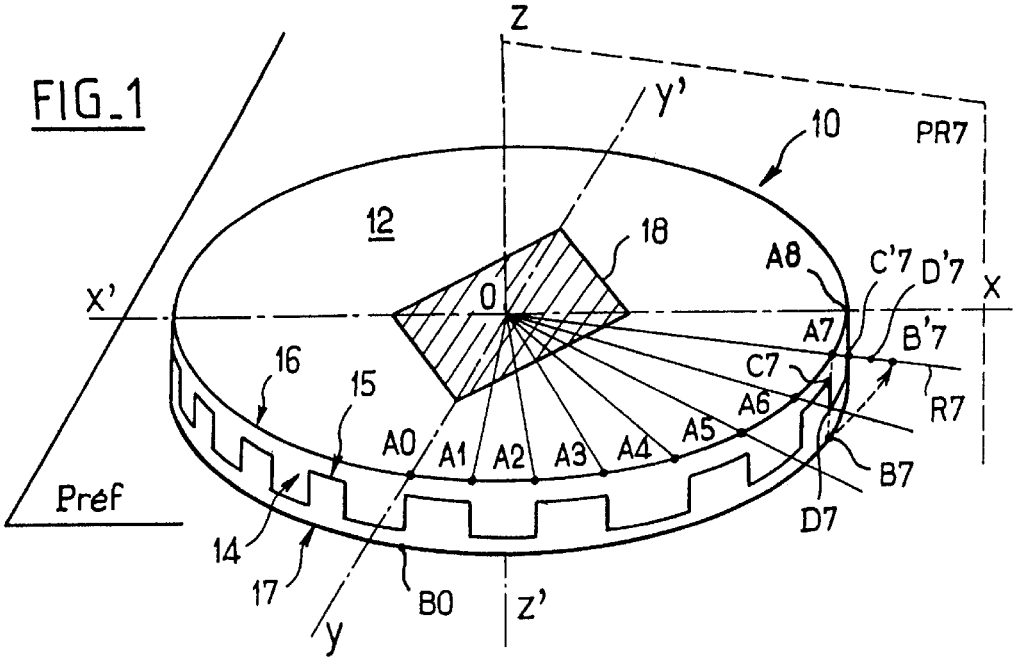
FIG. 1 shows a perspective view of a solid-straight-sided gambling chip with a side decoration.

FIG. 1 shows, in perspective, a gambling chip 10 made of plastic (for example made of polybutylene terephthalate PBT) having the general shape of a disc with parallel faces 12 and 13 and a solid straight side 14 (only the upper face 12 can be seen in FIG. 1). The surface of the straight side 14 is in the form of a right cylinder of axis ZZ' perpendicular to the faces of the chip (of height approximately equal to the thickness of the chip), this cylinder being bounded with respect to the faces by right-angled edges 16 and 17. By way of non-limiting example, the chip 10 has a diameter of 40 mm for a side thickness or height of about 3.3 mm, it being pointed out that, in some cases, the edges 16 and 17 may have a very slight chamfer (of about 0.1 mm), this having the effect, in particular, of extending the life of the pad.

Thus, the upper face 12 and its edge 16 both lie in the XX',YY' plane perpendicular to the ZZ' axis, this plane being chosen by convention as the reference plane Pref corresponding to the plane of the ink plate 11 (the origin O being chosen as the intersection of the three axes). The side 14 has a side decoration, in this case, and by way of non-limiting example, a crenellated line 15 consisting of sixteen symmetrical crenels distributed around the circumferential perimeter of the chip 10, the crenellated line 15 being moreover centred heightwise on the side 14.

Figure 2:
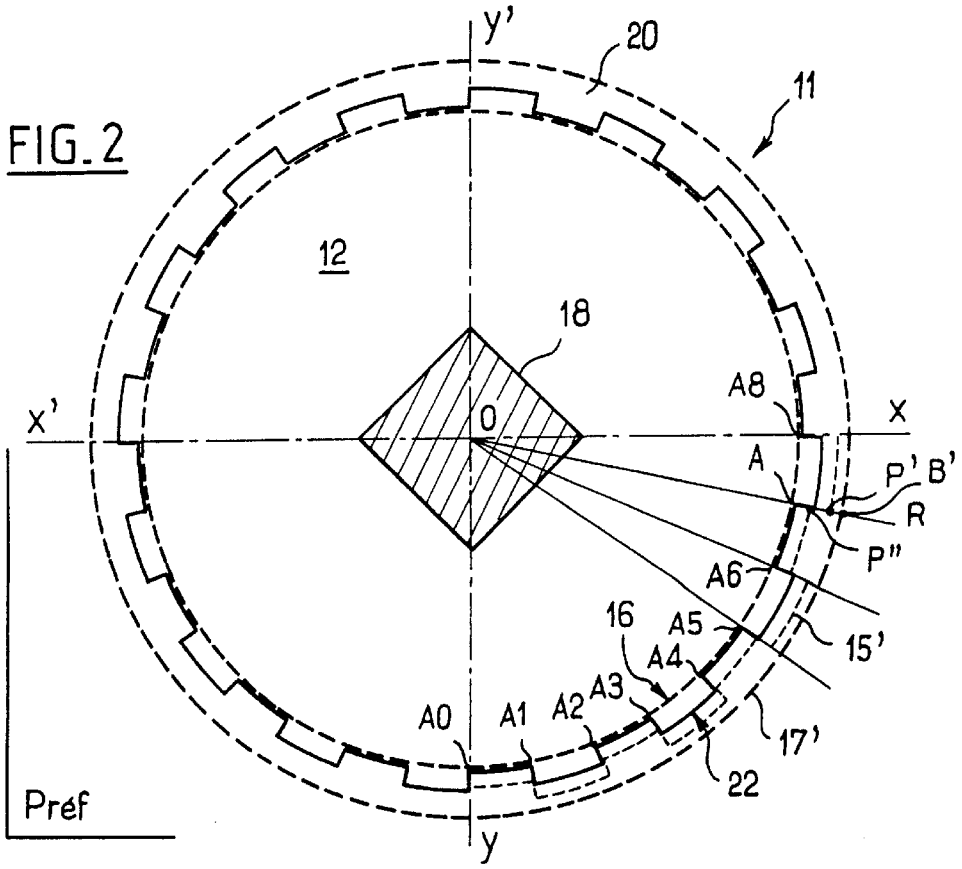
FIG. 2 shows a plan view of the ink plate used for producing the side decoration for the chip of FIG. 1 using the method of the invention.

FIG. 2 shows the drawing of the flat ink plate 11 corresponding to the upper face 12 and to the side 14 of the chip 10 and constructed directly in the reference plane Pref. Thus, the face 12 (reference face) which bears a face decoration (for example a coloured square 18) intended to be pad-printed together with the side decoration 15 is shown, to size, as the edge 16 (the reference edge) represented by a first dashed circle. Around the master image for the face 12 may be seen a ring-shaped zone 20 bounded by the edge 16 and the image 17' of the lower edge 17 of the chip 10 (this zone being represented by a second dashed circle 17' of larger diameter). The decoration image 22 for the side image 15 appears in the form of a crenellated circular curve between the two circles 16 and 17'. The decoration image 22 is obtained by radially deforming the side decoration 15, preferably in the following manner.

The face 12 is firstly divided by a certain number of radii OR into equal sectors, the angle of which, at the centre, between two successive radii OR(i) and OR(i+1), is chosen according to the definition desired for the decoration image (in this case, a sector having an angle of 11.25° at the centre is sufficient to cover each crenel of the decoration 15). In each radial plane PR defined by the ZZ' axis and a radius OR (for example the plane PR7 with the radius OR7), the generatrix defined by the intersection of the radial plane PR (in this case, the plane PR7) with the cylindrical side 14 of the chip (in this case, the generatrix A7 B7) is radially folded up onto the reference plane Pref by rotating it through 90° about the corresponding point of intersection A of the edge 16 with the radius OR (in this case, the point A7). In this way, the image point B'7 of the point B7 and all the folded-up intermediate points (in this case, the segment C'7 D'7) of the points of the original decoration 15 which lie along the generatrix A7 B7 (in this case, the segment C7 D7)

are constructed on the radius OR7. In this way, the image circle 17' of the edge 17 and the intermediate decoration 15', which is in the form of a crenellated circle (partially illustrated by the dotted line in FIG. 2), are constructed, point by point, in the reference plane Pref, i.e. on each radius OR, and radius after radius.

This radial folding-up operation is followed by a radial transformation in which the intermediate decoration 15' (illustrated by the moving point P') is contracted towards the internal circular border of the ring 20 (the edge 16), the point-by-point radial movement in the reference plane along each radius OR usually resulting in a reduction in the radial width (or height) of the intermediate decoration 15' (equal to the height of the decoration 15) in order to end up, in the reference plane, with the definitive decoration image 22 on the ink plate (illustrated by the moving point P"). Preferably, the contraction coefficient K for the height of the side decoration 15 is between 0.75 and 0.60, which gives a reduction in the height of the decoration of between 25 and 40%. Thus, a shortening coefficient $k(P') \leqq K < 1$ is determined, on each radius OR with respect to the point of relative origin A (lying at the intersection of the radius OR and the edge 16), for each value of the distance AP', this shortening coefficient making it possible to calculate the distance $AP''=k(P') \times AP'$ where AP" is the distance from the final image point P" (belonging to the decoration 22) to the origin point A, with $k(B')=K<1$. In general, the magnitude of the total radial displacement P'P" towards the edge 16 of each intermediate point P' lying on the segment AB' of a radius OR is greater the further the point P' is from the point A. It follows that a circle of centre O and radius OP' is transformed by radial contraction into another circle of centre O of smaller diameter having a radius $OP''=OA+(k(P') \times AP')$. The reduction coefficient K and the shortening coefficients k(P') essentially depend on the geometry of the pad and of the chip and on the deformation of the pad on the surface of the chip, but also, however, to a lesser extent, on the nature and surface finish of the surfaces in contact and on the properties of the inks employed. In practice, k(P') remains close to K and the choice of k(P')=K= constant is, however, often satisfactory.

It should be noted that these operations of radially deforming the decoration for the side of the chip in order to obtain the flat decoration image (radial folding-up and radial contraction transformation or, conversely, contraction along the side of the original decoration towards the edge of the reference face followed by radial folding) are capable of being carried out on a computerized workstation using computer-aided design software.

Of course, without departing from the scope of the invention, the gambling chip may be replaced by an object of similar shape made of a material capable of receiving a decoration by pad printing.

The operation of marking the side of a straight-sided gambling chip by pad printing secondarily with pad-printing of one of the faces of the chip can be performed by various types of devices, machines or apparatuses. By way of non-limiting example, FIG. 3 illustrates the principle of such an apparatus for implementing the invention, allowing one of the faces and the side of a disc-shaped gambling chip or of an object of similar shape to be marked simultaneously.

Considering FIG. 3, the reference 30 represents a horizontal support intended to act as a bearing surface for the solid-straight-sided chip 10. An ink pad 34 is mounted on a frame 31 so as to be able to move in vertical reciprocating motion. The pad 34 has an axially symmetrical deformable head 36 of axis ZZ' made of synthetic material (for example a synthetic silicone rubber having a Shore A hardness of about 6), in this case with a conical end 38. As will be seen later, the deformable head 36 is designed to bed down on the face 12 and the edge 16 of the chip 10 while the straight side 14 is being marked. A plate holder 40, carrying a flat ink plate 11 which incorporates the image of a side decoration (for example the decoration image 22 illustrated in FIG. 2), is capable of reciprocating motion between the position vertically beneath the pad 34 (position 40) and the position vertically beneath an ink reservoir 42 (position 40'). The pad-printing operation proper is carried out in the following manner. After inking the plate 11 (position 40'), the plate holder is moved into the position 40 coaxial with the pad 34 so as to place the ring-shaped zone 20 of the plate 11 coaxially with the pad 34. A first downward vertical movement of the pad 34 allows the ink to be picked up simply by applying pressure. After the pad 34 has been raised and the plate holder retracted (back to the position 40'), the pad 34 undergoes a second downward vertical movement in order to deposit the ink firstly by pressing on the face 12 of the chip 10 and then, by further deformation of the head of the pad 36, on the side 14. Marking with a monochrome (final or intermediate) decoration is thus achieved. In the case of multicolour printing, the final decoration is formed by a complementarity and/or superposition of monochrome decorations, each of these intermediate decorations being etched on separate plates. In the case of multicolour marking, either several movable plate holders or a series of monochrome pad-printing units associated with a movable chip-holder support are used. In general, the ink plates are etched to a depth of between 18 and 20 $\mu$m. Moreover, the various types of inks and/or varnishes suitable for pad printing can be used, especially UV-visible inks for discreet marking (for example in the case of chip identification numbers and/or codings).

It should be noted that, in the case of face-and-side marking, in order to solve the problem of the colours of the decoration marked in solid colour on the side of the chip lightening (due to the reduction in the amount of ink deposited per unit area because of the stretching of the inked pad), use is made, according to the invention, of one of the two following variants:

- either an ink plate having a halftone face decoration image (for example with 130 dots per inch) and a non-halftone side decoration image;
- or an ink plate having a decoration image for a face of the chip and a deeply-etched side decoration image, the etching of the side decoration image (about 25 $\mu$m) then being deeper than the etching of the decoration image for the face of the chip (about 18 $\mu$m). Such a plate is obtained by using a suitable mask.

As may be seen in FIGS. 4*a* and 4*b*, the chip is centred on the ZZ' axis of the pad by retractable vertical centering slides 32 having curved internal walls complementary with the side 14 of the chip 10 and being mounted so as to slide axially on the perimeter of the support 30. This centering operation, prior to the marking proper or in the initial phase of the marking, is important in order to position the chip 10 accurately with respect to the pad 34, especially in the present case so that the edge 16 is in precise correspondence with its inked image on the conical end 38 of the pad 34. After the conical end 38 has moved beyond the plane of the face 12, the centering slides 32 gradually retract (by means of any known mechanical arrangement) in order to allow the head 38 of the pad 34 to deform along the side 14, while bedding down on the edge 16 (the latter being sufficiently sharp to prevent undesirable slippage from the face 12 in the region of the edge) until complete inking of the side 14 when the end 38 (which is conical when not in use) of the deformable head 36 of the pad 34 is compressed (with the rim of the head 36 projecting slightly beyond the plane of the edge 17 of the lower face 13 of the chip 10). Finally, in order to prevent the chip 10 from lifting while the pad 34 is being retracted, means are provided for holding the chip 10 in place on its support 30, for example at least one adhesive patch 43 fixed to the support 30, the patch 43 being in contact with the lower face 13 of the chip 10 bearing on the support 30, and/or suction under partial vacuum (not shown). As a variant, it should be noted that the use of one or more patches 43 providing sufficient adhesion to ensure, once the chip has been centred by the slides 32, that the chip is held in place while it is being marked, makes it possible to retract the slides 32 even before the actual marking of the chip. Moreover, the slides 32 may be replaced by a retractable ring (not shown) mounted on the perimeter of the chip support.

Preferably, the pad 34 has a deformable head 36 with a substantially conical end and with a working diameter Dt at least equal to the diameter of the chip increased by five times the height of the side of the chip, for example a minimum diameter Dt of 55 mm for the chip 10 with a diameter of 40 mm and a side height of 3.3 mm.

Of course, the invention can be used with other types of pad, of various shapes and of various hardnesses, chosen from the manufacturers' standard ranges. Among these may be mentioned pads of cylindrical shape with a convex end, the diameter Dt of which satisfies the above criterion.

It is readily apparent that, using the marking method according to the invention, a small variation in the diameter of the chip, for example a few tenths of one mm, is distributed around the entire perimeter of the chip without affecting the circumferential continuity of the decoration thus marked.

As mentioned above, the invention also applies to soft-edged chips having a central straight side extending substantially over a large portion of the thickness of the chip and connected to the two faces of the latter by two transition zones (small fillets or broadened chamfers). By way of non-limiting example, the chip 60 shown diagrammatically in FIG. 5 has a diameter of 40 mm for a total side height of 3.3 mm, consisting of approximately 2.5 mm of central straight side and of two transition fillets having a radius of between 0.4 and 0.5 mm (with a theoretical radius in the injection mould of 0.5 mm).

Of course, the invention as described by way of non-limiting example for the solid-straight-sided chip 10, in particular the marking operations proper and its various variants, the marking device and its variants, the various pads, the general principle of preparing the plates by folding up onto the reference plane and radially contracting the intermediate decoration, and the plate-etching variants, is also applicable to a central-straight-sided chip, especially to the chip 60 illustrated in FIG. 5. However, beyond a certain dimension of the fillet and/or of the broadened chamfer (which can vary depending on the specifities of the marking, on the chip and on the pad), the softened edge of the chip leads to slippage of the pad in the region of the softened edge which often requires making a correction to the placement of the internal border of the ring bearing the decoration image and, possibly, to the contraction coefficient K. Thus, the internal border of the ring 70 bearing the decoration image is generally moved closer to the centre O of the chip.

FIG. 5 shows, in diagrammatic cross-section, the chip 60 of axis ZZ' with its reference face 62 of centre O included in the reference plane Pref (half-axis OX) corresponding to the flat ink plate 61, the peripheral circular border of the face 62 being shown by the point E. As illustrated in FIG. 5, the straight side of the chip 60 consists of a central straight side 64 (consisting of a cylindrical surface of axis ZZ' perpendicular to the plane Pref, which, projected on to the latter forms a circle of radius OJ and is represented by the segment FG) and of two transition zones, in this case two fillets 66 and 66' (consisting of surfaces of revolution having the general shape of a spherical ring or of a cone and represented by the circular quadrants EF and GH, the point H on the other face 63 of the chip 60 being the equivalent of the point E on the face 62).

The construction of the decoration image for the decoration 65 starts by that of the intermediate decoration 65' represented by the segment F'G' obtained by the curved portion EFG being radially folded up, with development beyond the point E, onto the radius OX, where EF'=1.571 EJ and F'G'=FG. Next, the intermediate decoration is radially contracted (in this case, with K=0.6) and the internal circular border of the ring 70, represented by the point F", is moved closer to the centre O, in this case it is made to coincide with the point J, in order to obtain the final decoration image 72 on the ring 70 represented by F"G" (with F"G"=K×F'G'=K×FG).

In order to make it easier to produce and position the decoration image, the position of the internal circular border of the ring 70 and the contraction coefficient K of the radial transformation are determined, for a given model of straight-sided chip (for example, the chip 60 having a side profile EFGH) and for a given pad, by marking the chip model using a positioning ink plate 80 centred on the axis ZZ' of the chip and bearing a pattern 82 consisting of closely-spaced concentric circles. The pattern 82, shown diagrammatically in FIG. 5 by the segment M1M23, is in the form of a ring of centre O, the mean radius OM of which is chosen to be close or equal to the radius OJ of the chip model and the width of which is chosen to be about twice the height h of the chip. By way of non-limiting example, the pattern 82 used for the chip 60 has 23 closely-spaced concentric circles 84 numbered from M1 to M23 and, in this case, spaced apart by 0.3 mm for a pattern width of about 7 mm. Secondarily, the pattern has segments (not shown) of 64 equally distributed radii crossing the concentric circles 84 in order to determine the lateral broadening of the decoration image with the distance from the centre O and to detect any possible lateral slippage of the pad. Thus, the positioning plate 80 is used to mark the straight side of the model of the chip 60. Next, the row of the concentric circles Mi and Me corresponding to the points F" and G" (in this case, the row 12 and the row 17, respectively illustrated by the circles M12 and M17) are identified by counting along the marked chip. Of course, the central straight side of the chip 60 is marked by pad printing by using, in a manner already described, the device illustrated in FIGS. 3, 4*a* and 4*b* (the chip 60 replacing the chip 10).

What is claimed is:

1. A method for marking a side of a straight-sided chip with a decoration by pad printing, said method comprising:

providing an ink plate with an image defined by a radially deformed representation of the decoration of the straight side of the chip in a ring-shaped zone;

moving a pad coaxially into contact with said ink plate such that said image transfers to said pad;

moving said pad coaxially into contact with said chip such that said image transfers to said side of said chip such that said side is marked with said decoration;

forming said image, said forming further comprising radially folding up said decoration for said side of said chip into a reference plane corresponding to a plane of said ink plate and including a face of said chip to produce an intermediate decoration; and contracting said intermediate decoration inward toward a circular border of said plane to radially transform said intermediate decoration.

2. The method of claim 1, wherein, said forming further comprises radially folding up said decoration for said side of said chip around a facial edge of said chip in a plane, and contracting said decoration for said side of the said chip toward said facial edge.

3. The method of claim 1, wherein a position of said circular border, and a contraction coefficient of the radial transformation are determined, for a given straight-sided chip model and a given pad, by marking the chip model using a positioning ink plate centered on the axis (ZZ') of the chip and bearing a pattern consisting of closely-spaced concentric circles.

4. The method of claim 1, wherein characteristics of the radial transformation are chosen to reduce a radial height of said intermediate decoration of between 25 and 40%, using a radial contraction coefficient of between 0.75 and 0.6.

5. The method of claim 1, wherein said circular border substantially corresponds to an edge of said face of said chip, which defines a reference edge.

6. The method of claim 5, wherein the radial transformation uses, as relative origin on each radius (OR), a corresponding point (A) on said reference edge.

7. The method claim 1, wherein said chip is circular, and said circular border substantially corresponds to a circular side on said face of said chip.

8. The method of claim 1, further comprising providing said pad, said pad being axially symmetric deformable, and having a diameter (Dt) at least equal to the diameter of the chip plus approximately five times a height of said side of said chip.

9. The method of claim 1, wherein said ink plate has a halftone image for said face of said chip, and a non-halftone image for said side of said chip.

10. The method of claim 1, wherein said ink plate has a first decoration image for said face of said chip and second decoration image for said side of said chip, said second decoration image being etched more deeply than said first decoration image.

11. A method for pad-printing a substantially cylindrical chip having opposing faces and a side, said method comprising:

defining a first decoration, including a first section for one of said opposing faces and a second section for at least a portion of said side of said chip;

radially deforming said second section to form a second decoration, said second decoration including said first section and a radially deformed second section;

providing an ink plate with said second decoration;

moving a pad coaxially into contact with said ink plate such that said second decoration transfers to said pad;

moving said pad coaxially into contact with said chip such that said second decoration transfers to said chip such that said radially deformed second section transfers to said side to print said second section in substantially its original state;

wherein a contraction coefficient of said radially deforming step is determined, for a given straight-sided chip model and a given pad, by marking the chip model using a positioning ink plate centered on an axis (ZZ') of the chip and bearing a pattern consisting of closely-spaced concentric circles.

12. The method of claim 11, wherein said radially deforming further comprises flattening said second section into a plane defined by said first section to form a ring around said first section, and shrinking said second section radially inward toward a center of said first section.

13. The method of claim 11, wherein said radially deforming further comprises compressing said second section, and flattening said second section into a plane defined by said first section to form a ring around said first section.

14. The method of claim 11, wherein characteristics of said radial deformation are set to reduce a radial height of said second section of between 25 and 40%, using, a radial contraction coefficient of between 0.75 and 0.6.

* * * * *